US009885229B2

(12) United States Patent
Kitzman

(10) Patent No.: US 9,885,229 B2
(45) Date of Patent: Feb. 6, 2018

(54) DISAPPEARING EXPANDABLE CLADDING

(71) Applicant: BAKER HUGHES INCORPORATED, Houston, TX (US)

(72) Inventor: Jeffery D. Kitzman, Spring, TX (US)

(73) Assignee: Baker Hughes, a GE Company, LLC, Houston, TX (US)

( * ) Notice: Subject to any disclaimer, the term of this patent is extended or adjusted under 35 U.S.C. 154(b) by 366 days.

(21) Appl. No.: 14/693,594

(22) Filed: Apr. 22, 2015

(65) Prior Publication Data

US 2016/0312570 A1 Oct. 27, 2016

(51) Int. Cl.

| | |
|---|---|
| ***E21B 43/26*** | (2006.01) |
| ***E21B 43/10*** | (2006.01) |
| ***E21B 33/13*** | (2006.01) |

(52) U.S. Cl.

CPC ..... *E21B 43/261* (2013.01); *E21B 33/13* (2013.01); *E21B 43/103* (2013.01)

(58) Field of Classification Search

CPC ..... E21B 33/13; E21B 43/261; E21B 43/108; E21B 43/11; E21B 43/26; E21B 43/103

See application file for complete search history.

(56) References Cited

U.S. PATENT DOCUMENTS

| | | | | |
|---|---|---|---|---|
| 2,214,226 | A | 9/1940 | English | |
| 2,261,292 | A | 11/1941 | Salnikov | |
| 3,216,497 | A | 11/1965 | Howard et al. | |
| 5,103,911 | A | 4/1992 | Heijnen | |
| 5,273,115 | A | 12/1993 | Spafford | |
| 7,306,044 | B2 * | 12/2007 | Connell | E21B 43/103 166/207 |
| 7,451,815 | B2 | 11/2008 | Hailey, Jr. et al. | |
| 7,461,699 | B2 | 12/2008 | Richard et al. | |
| 7,661,481 | B2 | 2/2010 | Todd et al. | |
| 7,762,342 | B2 | 7/2010 | Richard et al. | |
| 8,297,364 | B2 | 10/2012 | Agrawal et al. | |
| 8,342,240 | B2 | 1/2013 | Richard et al. | |
| 8,668,019 | B2 | 3/2014 | Casciaro | |
| 8,794,335 | B2 | 8/2014 | Fadul et al. | |
| 8,857,513 | B2 | 10/2014 | O'Malley | |
| 2004/0144538 | A1 | 7/2004 | Richard et al. | |
| 2005/0205264 | A1 * | 9/2005 | Starr | E21B 33/134 166/376 |

(Continued)

FOREIGN PATENT DOCUMENTS

| | | | |
|---|---|---|---|
| WO | 2014099208 | A1 | 6/2014 |

*Primary Examiner* — Michael R Wills, III

(74) *Attorney, Agent, or Firm* — Steve Rosenblatt

(57) ABSTRACT

Perforations in an existing borehole are covered with an expandable clad or elongated tubular that is expanded on location with the expansion equipment then removed. The clad is made of a disintegrating material such as a controlled electrolytic material known as CEM and is expanded into position to cover the existing perforations. One or more plugs are run in with perforating guns and the plugs set with the guns moved away from the set plug and fired to make new perforation. After each new perforation is made a ball is delivered to the plug to isolate a portion of the well and the new perforations are treated such as in a fracturing or another operation. Over time or with exposure to well fluids or temperatures the clad disintegrates and the original well drift diameter is regained so that subsequent production or injection is not impeded.

22 Claims, 2 Drawing Sheets

(56) References Cited

U.S. PATENT DOCUMENTS

| | | | | |
|---|---|---|---|---|
| 2010/0006293 | A1 | 1/2010 | Gu et al. | |
| 2011/0121516 | A1 | 5/2011 | Hallundbaek | |
| 2011/0136707 | A1 | 6/2011 | Xu et al. | |
| 2012/0152567 | A1* | 6/2012 | Whiddon | E21B 43/106 166/382 |
| 2013/0000914 | A1* | 1/2013 | Kelbie | E21B 43/103 166/308.1 |
| 2013/0299185 | A1 | 11/2013 | Xu et al. | |
| 2014/0014339 | A1 | 1/2014 | O'Malley et al. | |
| 2014/0027127 | A1 | 1/2014 | Frazier et al. | |
| 2014/0060830 | A1* | 3/2014 | Love | E21B 43/103 166/280.1 |
| 2014/0060837 | A1* | 3/2014 | Love | E21B 43/26 166/297 |
| 2015/0053397 | A1 | 2/2015 | Filyukov et al. | |
| 2016/0290091 | A1* | 10/2016 | Takahashi | C08L 67/04 |

* cited by examiner

DISAPPEARING EXPANDABLE CLADDING

FIELD OF THE INVENTION

The field of the invention is subterranean completions and more particularly where existing wellbore penetrations are covered to facilitate a procedure and the clad used for such covering later disintegrates to allow recapture the previous inside diameter for subsequent operations.

BACKGROUND OF THE INVENTION

In some wells the existing perforations start trailing off on production and the need arises to enhance production from the well with additional perforations into the producing formation at different locations from the original perforations that can then be fractured.

The task of sealing off the old perforations has been undertaken in a variety of ways. They can be straddled with swelling packers as in US 20150053397. Another way is to pump material into the existing perforations such as a controlled electrolytic material also known as CEM into the existing perforations while making new perforations followed by delivering material to the borehole that removes the CEM from the existing perforations. This is illustrated in U.S. Pat. No. 8,857,513. An older technique involved pumping a solidifying material into the existing perforations to seal them and then making new perforations for the continuation of production. This method is illustrated in U.S. Pat. No. 5,273,115.

There are uncertainties in the technique that seeks to plug the existing perforations with a material in that the completeness of the delivery into the perforations cannot easily be determined. Additionally the pressure needed to deliver such materials into the perforations deep enough to get a seat, even if that seal is temporary, can adversely affect subsequent production. Then there are some doubts that all the plugging material has been effectively disintegrated from inside the perforations, which can also impede subsequent production.

The present invention seeks to overcome such uncertainties of prior methods by providing an expandable tubular that can span the perforations in the borehole to facilitate making new perforations and fracturing the new perforations or otherwise performing a treatment operation through the new perforations. The expandable tubular will degrade or disintegrate with time to allow the original well drift diameter to be resumed as well as the original perforations to reopen when production or injection resumes. These and other aspects of the present invention be more readily apparent to those skilled in the art from a review of the detailed description of the preferred embodiment and the associated drawings while recognizing that the full scope of the invention can be determined from the appended claims.

Also relevant in general to the subject of barriers that disappear or degrade are U.S. Pat. Nos. 8,794,335; 8,668,019; 8,297,364; 7,661,481; 7,461,699; 7,451,815; 5,103,911; 3,216,497; 2,261,292; 2,214,226 and 2014/0027127.

SUMMARY OF THE INVENTION

Perforations in an existing borehole are covered with an expandable clad or elongated tubular that is expanded on location with the expansion equipment then removed. The clad is made of a disintegrating material such as a controlled electrolytic material known as CEM and is expanded into position to cover the existing perforations. One or more plugs are run in with perforating guns and the plugs set with the guns moved away from the set plug and fired to make new perforation. After each new perforation is made a ball is delivered to the plug to isolate a portion of the well and the new perforations are treated such as in a fracturing or another operation. Over time or with exposure to well fluids or temperatures the clad disintegrates and the original well drift diameter is regained so that subsequent production or injection is not impeded.

DETAILED DESCRIPTION OF THE PREFERRED EMBODIMENT

Figure 1:
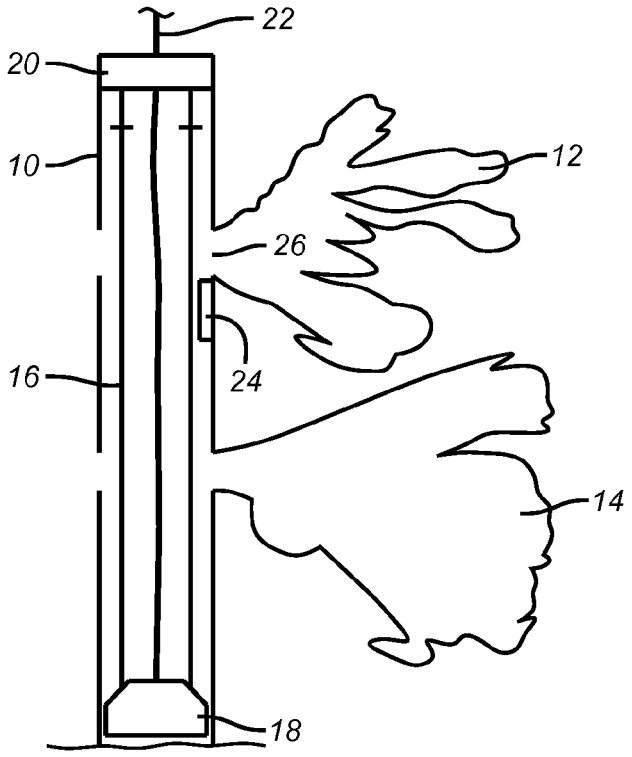
FIG. 1 is an illustration of the clad delivered into an existing well over existing perforations with the expansion equipment.

Referring to FIG. 1 borehole 10 has existing perforations 12 and 14. A clad or long tubular 16 is run in with a swage 18 at a lower end and an anchor/stroker 20 of a type known in the art on the upper end with the assembly supported from the surface by a string or wireline or equivalent for proper positioning to straddle the existing perforations 12 and 14. While two existing perforations are shown any number of perforations can be spanned by the clad 16. The borehole 10 can be cased with perforations such as 12 having an adjacent sliding sleeve 24. The clad 16 can be expanded over the opening 26 or/and the sliding sleeve 24 that is generally positioned in a recess in the tubular that defines the borehole 10. Alternatively, the borehole 10 can be in open hole.

Figure 2:
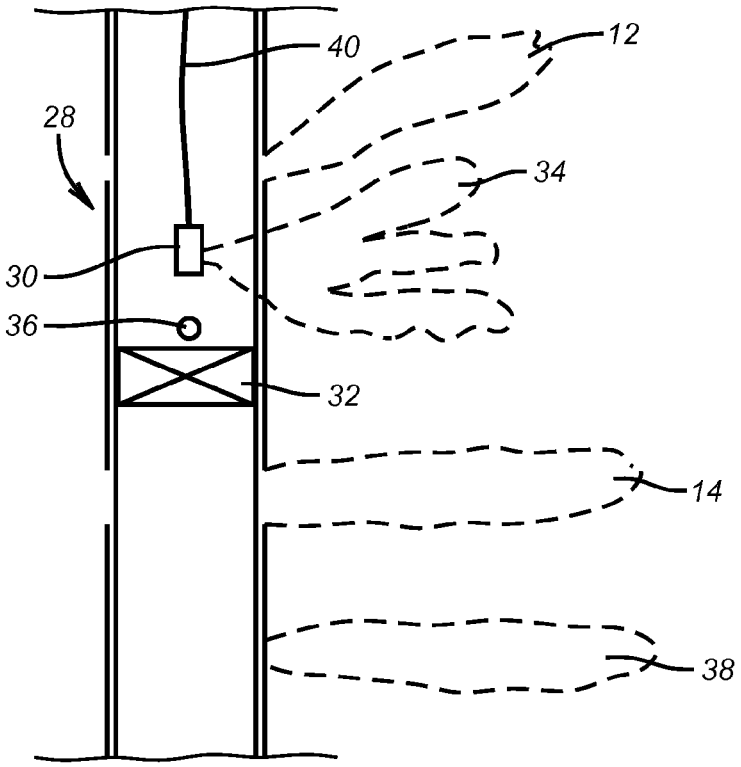
FIG. 2 is the view of FIG. 1 after expansion and removal of the expansion equipment and with the bottom hole assembly in position after the plug has been set and the perforating gun repositioned and fired and an object released to allow the plug to hold pressure for treatment of a new perforation.

FIG. 2 shows the clad 16 expanded after the swage 18 is forced through it and the expansion tools shown in FIG. 1 replaced with a bottom hole assembly 28 that is delivered into the clad 16. However, before the bottom hole assembly 28 is run in, additional equipment could be run prior to re-perforating to ensure the pressure integrity of the clad 16 is sufficient to withstand upcoming hydraulic fracturing operations. Item 30 schematically represents a setting tool for the plug 32 and a perforating gun. The plug 32 is set and the gun is released from it and repositioned and fired to create a new perforation 34 after which the remaining BHA is retrieved. The new perforations such as 34 or 38 can be made through the clad 16 or in other parts of the wellbore spaced from the clad, as needed. From surface the ball 36 is dropped into a seat around a passage in the plug so that the plug 32 fully acts as an isolator. As an alternative the clad 16 can be expanded with a variable swage (not shown) to create a seat in the clad 16 which can accept an object from the surface for isolation purposes and to enable a treatment procedure. As another alternative the clad 16 may be formed with a profile that later accepts a plug to create a barrier that facilitates the subsequent treatment with fluid pressure. Pressure is then introduced to fracture the perforation 34 or to otherwise treat the new perforation. Preferably the new perforations are made right through the clad 16 in a bottom up order to ensure each sequential plug isolates the previously treated perforations. Thus for example, perforation 38 is made before perforation 34. The assembly 30 can be rapidly deployed on wireline 40 and pumped to the location taking advantage of exterior cup seals in a manner known in the art. The assembly 30 is of a type known in the art and can be pulled out each time the gun is fired. The plugs such as 32 and the balls 36 can also be made of disintegrating materials to aid in ultimate removal in a manner that is also known in the art.

Figure 3:
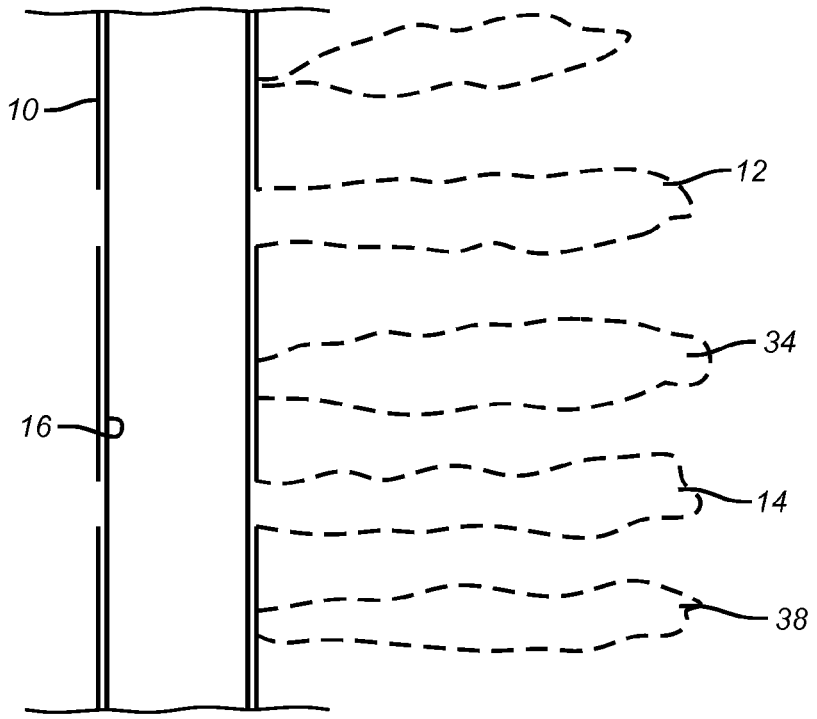
FIG. 3 is the view of FIG. 2 after completion of all the treatment of the new perforations.
Figure 4:
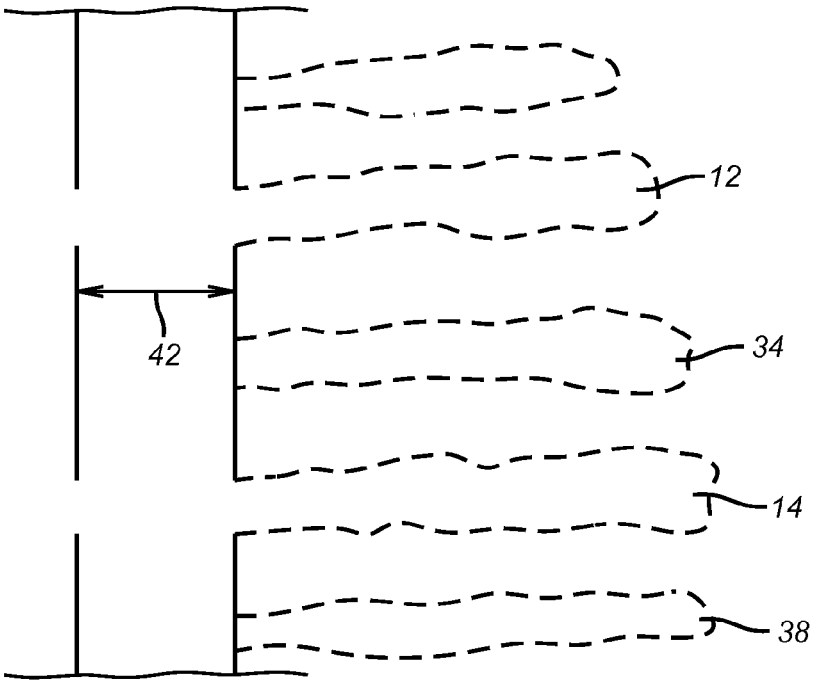
FIG. 4 is the view after the clad has disintegrated.

After all the additional perforations such as 38 and 34 are created and the bottom hole assembly 30 pulled out of the hole for the last time, the clad 16 remains for a time as shown in FIG. 3. The plugs such as 32 have been either milled out or allowed to disintegrate and over time or with exposure to well fluids, heat or through added fluids in the borehole the clad 16 which is preferably made of a controlled electrolytic material or CEM disintegrates and the view of FIG. 4 illustrates that the original bore drift dimension 42 is regained as the clad is no longer present. Controlled electrolytic materials have been described in US Publication 2011/0136707 and related applications filed the same day. Other materials that degrade or disintegrate are also contemplated to save an intervention into the borehole. As shown in FIG. 4 both the original perforations 12 and 14 and the new perforations 34 and 38 are open for production with the clad 16 having disintegrated or otherwise been removed. The use of the clad 16 takes away the uncertainties of past methods when trying to close off the existing perforations. The complete removal of the clad 16 after new perforations 34 and 38 are created and then treated allows production or injection into all the perforations with the original drift dimension of the well regained. Treatment methods encompass but are not limited to, hydraulic fracturing, stimulation, tracer injection, cleaning, acidizing, steam injection, water flooding, cementing, etc. Although a single clad 16 can cover all or less than all of the existing perforations or access locations to a formation, a clad for each perforation access location to a formation is also envisioned.

The above description is illustrative of the preferred embodiment and many modifications may be made by those skilled in the art without departing from the invention whose scope is to be determined from the literal and equivalent scope of the claims below:

I claim:

1. A subterranean treatment method, comprising: running in a disintegrating clad to at least one existing access location to a formation from a borehole; isolating by covering said at least one existing access location with said clad; creating, after said isolating, at least one new access location to the formation spaced apart in the borehole from said at least one existing access location; treating the formation through said at least one new access location reopening said at least one existing access location after said treating with disintegration of said clad.

2. The method of claim 1, comprising:
creating said new access location through said clad or at a spaced location away from said clad.

3. The method of claim 1, comprising:
expanding said clad to accomplish said isolating.

4. The method of claim 3, comprising:
moving a swage through said clad to accomplish said expanding.

5. The method of claim 3, comprising:
pressure testing the integrity of said clad after said expanding and before creating a said new access location.

6. The method of claim 3, comprising:
variably expanding said clad to create at least one seat therein to accept at least one object for selective blocking off said clad in furtherance of treating the formation through said at least one new access location.

7. The method of claim 3, comprising:
providing at least one profile in said clad to accept at least one plug for selective blocking off said clad in furtherance of treating the formation through said at least one new access location.

8. The method of claim 1, comprising:
making said clad from a controlled electrolytic material.

9. The method of claim 1, comprising:
providing, as said at least one existing access location, a plurality of spaced apart existing access locations;
isolating a plurality of said initial access locations with said clad.

10. The method of claim 9, comprising:
providing, as said at least one new access location, a plurality of new access locations through said clad or away from said clad at locations spaced from said initial access locations.

11. The method of claim 10, comprising:
making said clad from a controlled electrolytic material.

12. The method of claim 11, comprising:
disintegrating said clad from borehole exposure over time, or exposure to heat or exposure to wellbore fluids.

13. The method of claim 10, comprising:
sequentially creating said new access locations in a bottom up direction.

14. The method of claim 10, comprising:
alternating creation of said new access locations with said treating the formation through said newly created access locations.

15. The method of claim 14, comprising:
using at least one perforating gun for said creating new access locations.

16. The method of claim 15, comprising:
running in an isolation device with said at least one perforating gun in a single trip on wireline.

17. The method of claim 16, comprising:
setting said isolation device in said clad before releasing and repositioning said at least one gun for creation of a said new access location.

18. The method of claim 17, comprising:
dropping a ball onto a seat on said isolation device after firing said at least one gun to create said new access location.

19. The method of claim 18, comprising:
performing said treating into said new access location with pressure applied against said isolation device with said ball on said seat.

20. The method of claim 19, comprising:
performing as said treating at least one of hydraulic fracturing, stimulation, tracer injection, cleaning, acidizing, steam injection, water flooding and cementing.

21. The method of claim 1, comprising:
performing as said treating at least one of hydraulic fracturing, stimulation, tracer injection, cleaning, acidizing, steam injection, water flooding and cementing.

22. The method of claim 12, comprising:
performing as said treating at least one of hydraulic fracturing, stimulation, tracer injection, cleaning, acidizing, steam injection, water flooding and cementing.

* * * * *